US011957192B2

(12) United States Patent
Lizotte

(10) Patent No.: US 11,957,192 B2
(45) Date of Patent: Apr. 16, 2024

(54) CUP FOR CAPTURING AEROSOLIZED MUCOSAL DROPLETS

(71) Applicant: Pierre Lizotte, Burnaby (CA)

(72) Inventor: Pierre Lizotte, Burnaby (CA)

( * ) Notice: Subject to any disclaimer, the term of this patent is extended or adjusted under 35 U.S.C. 154(b) by 259 days.

(21) Appl. No.: 17/388,565

(22) Filed: Jul. 29, 2021

(65) Prior Publication Data

US 2022/0047014 A1 Feb. 17, 2022

Related U.S. Application Data

(60) Provisional application No. 63/066,462, filed on Aug. 17, 2020.

(51) Int. Cl.
*A41D 13/00* (2006.01)
*A41D 13/11* (2006.01)

(52) U.S. Cl.
CPC ..... *A41D 13/1138* (2013.01)

(58) Field of Classification Search
CPC ..... A41D 13/1138; A41D 13/11
See application file for complete search history.

(56) References Cited

U.S. PATENT DOCUMENTS 4,167,185 A * 9/1979 Lewis ..... A61M 16/0616 128/206.24
4,550,856 A * 11/1985 Ballmann ..... B65D 83/00 128/202.13
6,945,249 B2 * 9/2005 Griesbach, III ... A41D 13/1176 128/206.19
9,723,880 B1 * 8/2017 Macey, Jr. ..... A41D 13/11
2007/0199567 A1 8/2007 Kanzer
2009/0145445 A1 * 6/2009 Quinn ..... A41D 13/1138 128/863
2010/0118652 A1 7/2010 Ariessohn
2010/0218774 A1 * 9/2010 Flaherty ..... A41D 13/1138 29/428
2011/0226253 A1 * 9/2011 Johnston ..... A41D 13/1123 128/206.19
2017/0299477 A1 10/2017 Milton

* cited by examiner

*Primary Examiner* — Steven O Douglas

(57) ABSTRACT

A cup for capturing droplets expelled during coughing or sneezing, the cup has a sidewall having an inner surface and an outer surface. The sidewall has a lip portion of sufficient size for a snug substantially circumferential location over a nose and mouth of an intended user. The sidewall is configured and sized to be hand-held. An absorbent liner is located against the inner surface of the sidewall, the absorbent liner being sufficiently absorbent to capture and hold the expelled droplets during coughing or sneezing.

14 Claims, 4 Drawing Sheets

FIG. 2A
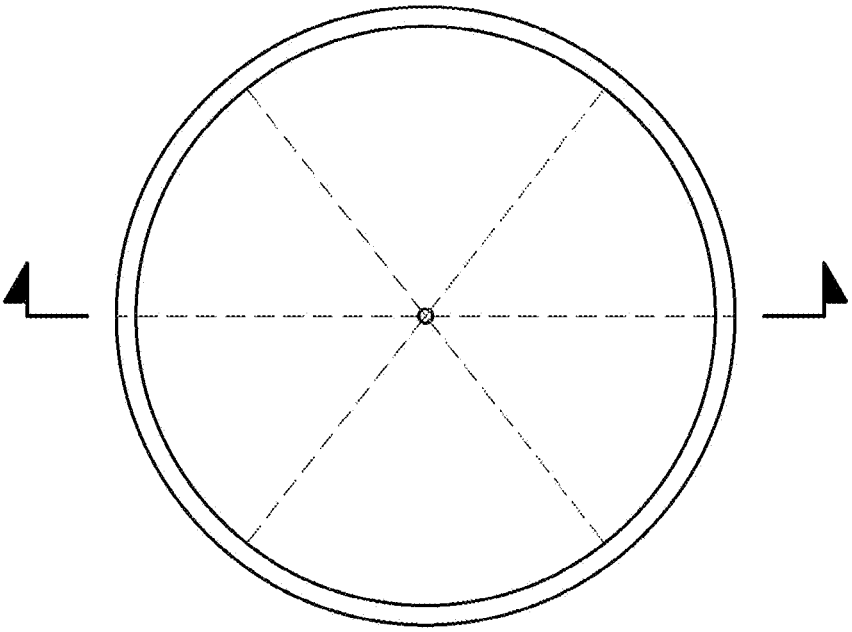
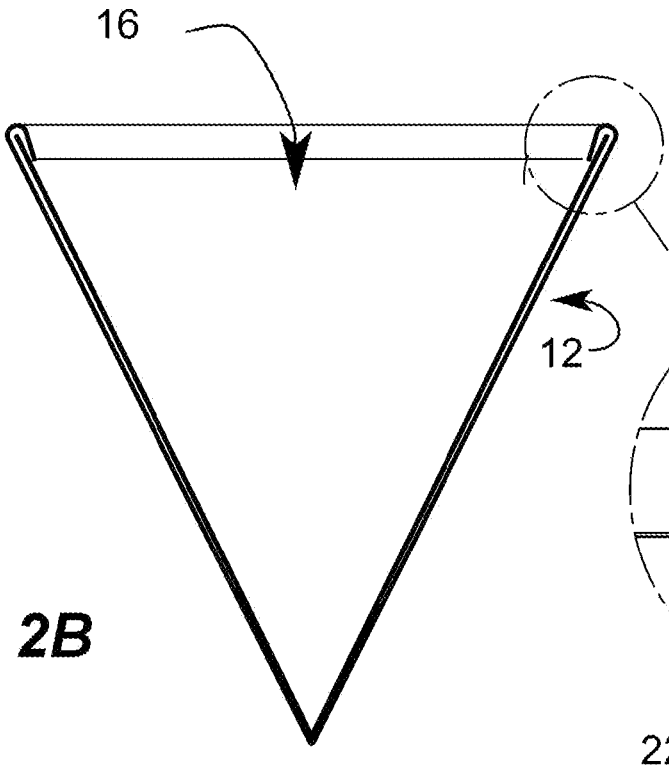
FIG. 2B
FIG. 2C
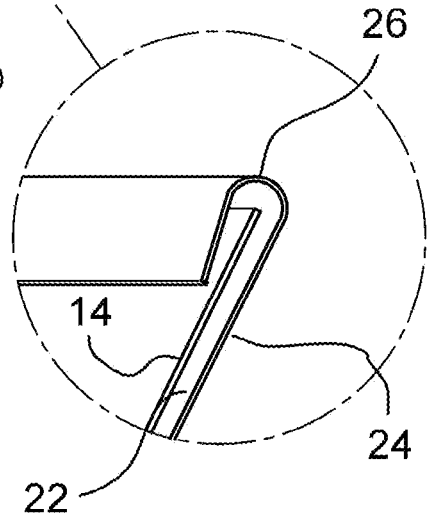

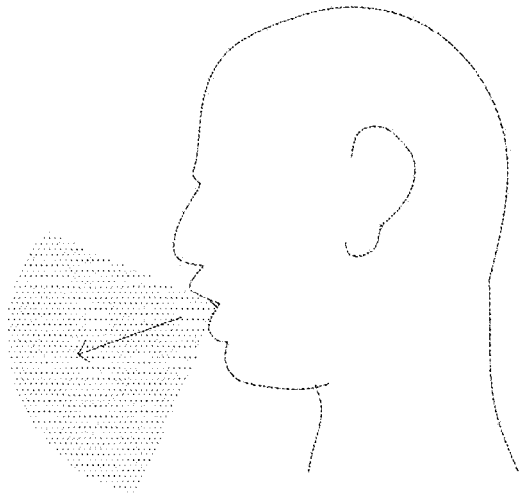
FIG. 4A
FIG. 4B
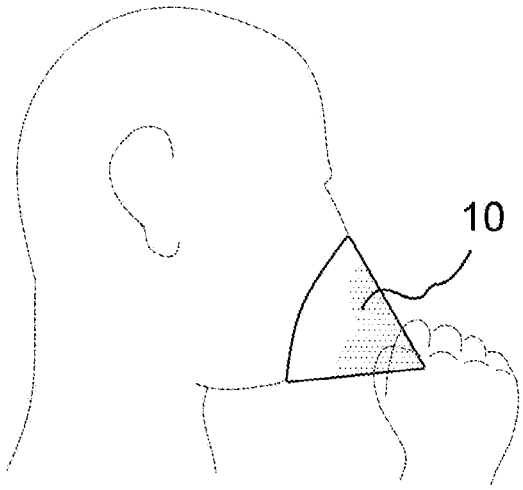

CUP FOR CAPTURING AEROSOLIZED MUCOSAL DROPLETS

CROSS-REFERENCE TO RELATED APPLICATIONS

The present application claims priority to provisional No. 63/066,462, filed on Aug. 17, 2020 entitled "receptacle for capturing aerosolized mucosal droplets", the disclosure of which is hereby incorporated in its entirety at least by reference.

BACKGROUND OF THE INVENTION

1. Field of the Invention

The present generally concerns personal hygiene accessories, and more particularly to accessories useful to capture droplets caused by sneezing and coughing.

2. Description of Related Art

The Coughing and sneezing are the contributing factors in many human-to-human transmissions of viral and bacterial infections. Typically, coughing and sneezing cause aerosolization of viruses and bacteria in droplets of mucous that are expelled from the respiratory airways, in particular the nose and mouth of the infected person. While personal hygiene is promoted in society with the use of facemasks, hand-washing, handkerchiefs (if available), some people fail to abide by simple personal hygiene practices. On the other hand, there may be instances where a person is too slow to capture the contents of the nose and mouth during a rapid onset of a sneeze or a cough. This can be a cause for concerns, especially when a disease is particularly virulent, spreads quickly and survives outside of the body for prolonged periods.

Respiratory diseases such as the "common" cold, influenza, COVID-19 caused by the coronavirus and the like, spread rapidly though the population when people sneeze and/or cough in an uncontrolled manner, especially in enclosed environments. In some cases, if left untreated, such diseases can be fatal to the elderly or immuno-compromised people.

Thus, there is a need for an inexpensive, easy to use and quickly dispensable cup for capturing droplets.

BRIEF SUMMARY OF THE INVENTION

It is a main object of the present disclosure to provide for a cup for capturing aerosolized mucosal droplets.

In order to do so, there is provided a cup that can be used to prevent spread of airborne diseases spread by aerosolization of mucosal droplets. The droplets are typically expelled from the nose and mouth of an intended user, usually a human intended user, when the intended user coughs or sneezes. If the cough or sneeze happens quickly and without notice, as often happens if the intended user is suffering from a common cold, the cup can be applied to the nose and mouth area covering them and preventing further droplets from being spread. The cup is lined with a cotton material that absorbs the droplets and prevents further spread. The cup also includes an opening that can be quickly molded to cover the mouth and nose. Furthermore, the cups are housed in a dispenser which can hold up to 100 cups. The cotton material allows for a snug fit with the outside of the adjacent cup when stored in the dispenser. Both the cup and the dispenser are inexpensive to manufacture. The cups can be a single-use item or multiple use item that can be quickly and safely disposed of, either by incineration or, if made from biodegradable material, in landfill sites. A single cup may be used multiple times in locations such as hospitals where doctors or caregivers can repeatedly use a single cup until such time as they can dispose of it.

Accordingly, in one embodiment there is provided a cup for capturing droplets expelled during coughing or sneezing, the cup comprising:

a sidewall having an inner surface and an outer surface, the sidewall having a lip portion defined by the sidewall folding and overlapping an absorbent liner located against the inner surface of the sidewall; the lip portion is of sufficient size for snug, substantially circumferential location over a nose and mouth of an intended user, the sidewall being sized and shaped to be hand-held; and the absorbent liner being sufficiently absorbent to capture and hold the expelled droplets during coughing or sneezing.

In one example, the lip portion is generally circular.

In one example, the lip portion is moldable to fit snugly against the skin around the nose and the mouth of the intended user.

In another example, the sidewall tapers to a point away from the lip portion.

In another example, the cup is cone-shaped.

In one example, the absorbent layer extends substantially over the entire inner surface of the sidewall.

In yet another example, the absorbent layer is made from a cotton material.

The cup works in combination with a cup dispenser for housing and dispensing a cup for capturing droplets expelled during coughing or sneezing and a dispenser for the cups comprising: a housing configured and sized to hold therein at least one cup; the housing further comprised of a front viewing wall, a mounting sidewall located at the rear of the housing, a lower dispensing end, and an upper charging portion; the mounting sidewall being used for mounting the dispenser on a surface.

BRIEF DESCRIPTION OF THE SEVERAL VIEWS OF THE DRAWINGS

Other features and advantages of the present invention will become apparent when the following detailed description is read in conjunction with the accompanying drawings, in which:

FIGS. 2A-C are a top view, a side cutaway view and a side detail view, respectively, featuring the absorbent layer, according to an embodiment of the present invention.

FIGS. 4A-B are side views illustrating a sneezing person with no cup and an intended user using the cup to sneeze in, according to an embodiment of the present invention.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein.

Figure 1:
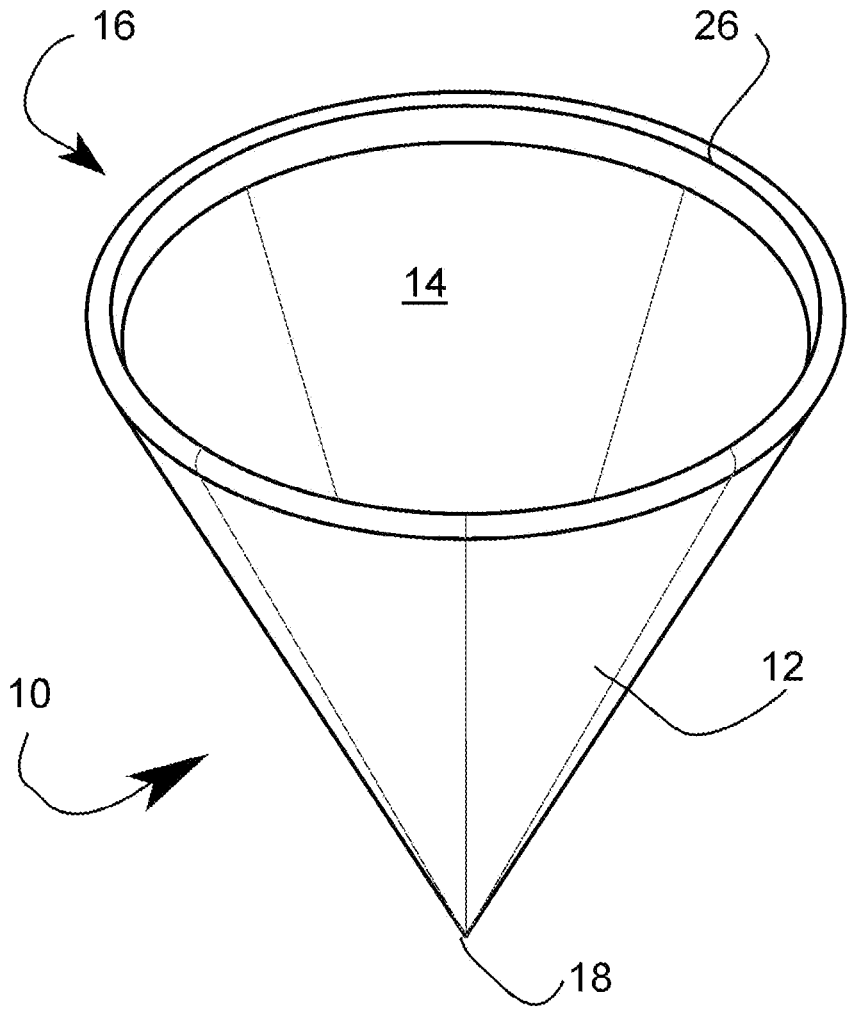
FIG. 1 is an isometric view of a cup, according to an embodiment of the present invention.

Referring now to any of FIGS. 1 to 3, there is shown generally a cup 10 for capturing droplets expelled during coughing or sneezing. Generally speaking, the cup 10 includes a sidewall 12 which defines the external shape of the cup 10, and a separate absorbent layer 14 co-joined to an interior surface 22 of the sidewall (12) which, obviously, also has an outer surface 24. The cup 10 is generally cone-shaped, having a wide mouth and nose portion 16 and a pointy end 18. This shape is ideally suited for loading, storing and quickly dispensing one or a plurality of cups 10 from a dispenser 20. Furthermore, the cup 10 is ideal for use with the human hand for quickly grabbing and pulling it out from the dispenser 20.

Referring more particularly to FIGS. 1 and 2, the sidewall 12 has a lip portion 26 defined by the sidewall 12 folding and overlapping the absorbent layer 14. The lip portion 26 is flexible, sized and configured for providing a snug, substantially circumferential fit over the nose and mouth of an intended user 44.

In the examples described herein, the intended users 44 are human of any age. One of the key advantages of the cup 10 is its ability to quickly mold to the shape and proportions of a human face so that a temporary hermetic seal is created between the lip portion 26 and the skin around the nose and the mouth so that the droplets expelled do not spread.

In most cases, the cups 10 significantly reduces or essentially eliminates the spread of the droplets in the immediate area around the face.

When viewed from above, the lip portion 26 defines a generally circular border. The sidewall 12 of the cup 10 tapers towards the pointy end 18, away from the lip portion 26.

Referring now to FIGS. 2A-C, the absorbent liner 14 is located against the inner surface 22 of the sidewall 12. The absorbent liner 14 is made from a material that is sufficiently absorbent to capture and hold the expelled droplets during coughing or sneezing. The absorbent liner 14 substantially covers the entire inner surface 22.

Generally speaking, the absorbent layer 14 is made from a material that is generally non-irritating such as a natural fiber. One such fiber is cotton, or a cotton blend material. A person skilled in the art will also recognize that the absorbent layer can, in certain environments, include embedded therein, anti-microbial agents. This is particularly useful in environments such as hospitals or homes for the elderly.

The absorbent layer 12 can be cut to provide a sufficiently snug fit against the inner surface 22 of the cone 10 or an adhesive can be used to stick the layer to the inner surface 22. In the latter case, the adhesive would preferably be non-toxic and non-irritating to the skin.

Figure 3A:
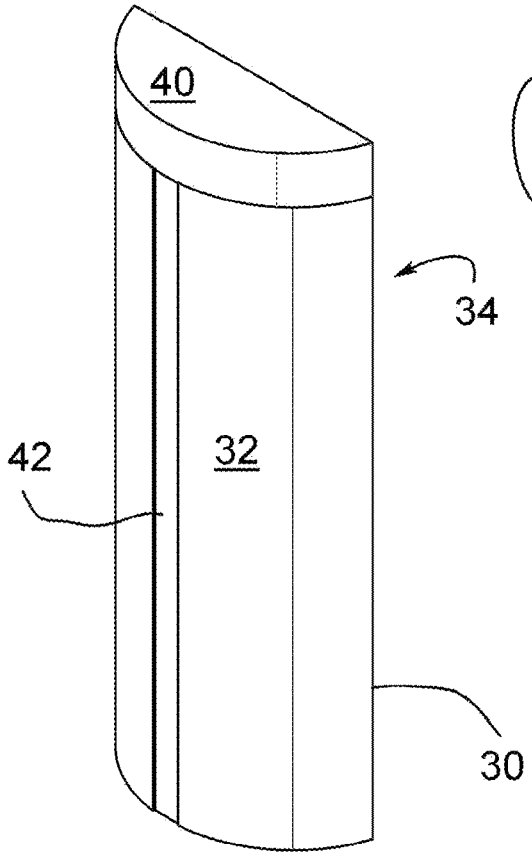
FIGS. 3A-B are an isometric and a front see-through view, respectively of a cup dispenser, according to an embodiment of the present invention.
Figure 3B:
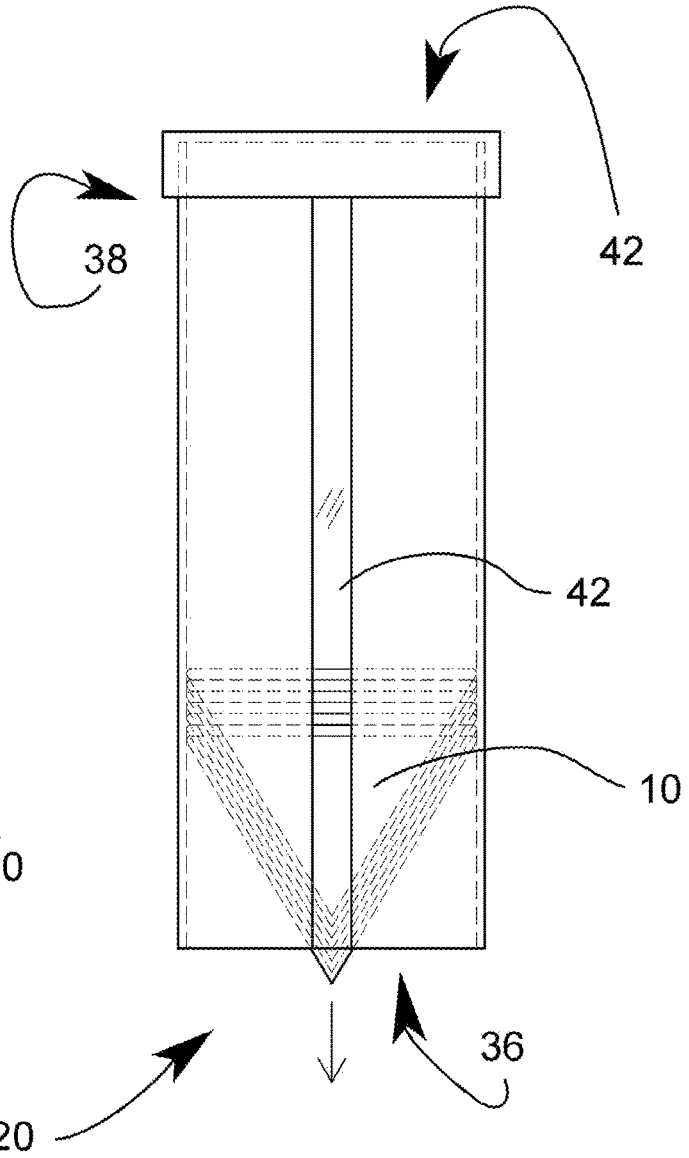

Looking now at FIGS. 3A-B, which show the dispenser 20, used to house and dispense one or more cups 10. The dispenser 20 is made of a lightweight material which can be conveniently located anywhere needed. The dispenser 20 includes a housing 30 that is configured and sized to hold therein at least one cup 10. Typically, up to 100 cups 10 can be housed at one time, whereas a single cup 10 is still able to be dispensed until the dispenser 20 is empty and needs to be loaded up. The housing 30 includes a front viewing wall 32, a mounting sidewall 34 located at the rear of the housing 30, a lower dispensing end 36 and an upper charging portion 38. The mounting sidewall 34 is used to mount the dispenser 20 on a wall, a door, or any surface that is deemed convenient. A person skilled in the art will readily understand that many types of mounting means are available such as brackets, magnets, adhesives and the like. The upper charging portion 38 includes a hinged flap 40 shown here in its closed configuration. The hinged door 40, when in the closed configuration covers a charging opening 42 and allows for the pointy end 18 to extend partially away from the dispensing end 36. The hinged door 40, when In the open configuration, allows for a plurality of the cups 10 to be loaded into the housing 30. To help a user know when the dispenser 20 needs to be recharged with new cups 10, a viewing window 42 is disposed at the front viewing wall 32 for monitoring the remaining cups 10.

The viewing window 42 extends between the charging portion 38 and the dispensing end 36. The at least one cup 10 are retained in the housing 30 so that the point end 18 of the cup 10 extends partially away from the dispensing end 36 a sufficient distance to allow the intended user 44 to pull the at least one cup 10 away from the housing 30.

The plurality of cups 10 are snugly mounted in each other to form a line of cups 10 which can be easily located in the housing when empty.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A cup for capturing droplets expelled during coughing or sneezing comprising:

a sidewall having an inner surface and an outer surface, the sidewall having a lip portion defined by a sidewall folding and overlapping an absorbent liner located against the inner surface of the sidewall; the lip portion is configured and sized for, snug, substantially circumferential location over a nose and mouth of an intended user, the sidewall being configured and sized to be hand-held; and the absorbent liner being absorbent to capture and hold the expelled droplets during coughing or sneezing.

2. The cup of claim 1 wherein: the lip portion is generally circular.

3. The cup of claim 1 wherein: the lip portion is moldable to fit snugly against the skin around the nose and the mouth of the intended user.

4. The cup of claim 1 wherein: the sidewall tapers to a point away from the lip portion.

5. The cup of claim 1 wherein: the cup is cone-shaped.

6. The cup of claim 1 wherein: the absorbent layer extends substantially over the entire inner surface of the sidewall.

7. The cup of claim 1 wherein: the absorbent layer is made from a cotton material.

8. A combination of a cup dispenser for housing and dispensing a cup for capturing droplets expelled during coughing or sneezing and a dispenser for the cups comprising:

a housing configured and sized to hold therein at least one cup; the housing further comprised of a front viewing wall, a mounting sidewall located at the rear of the housing, a lower dispensing end, and an upper charging portion; the mounting sidewall being used for mounting the dispenser on a surface; the cup comprising a sidewall having an inner surface and an outer surface, the sidewall having a lip portion defined by a sidewall folding and overlapping an absorbent liner located against the inner surface of the sidewall; the lip portion is configured and sized for snug, substantially circumferential location over a nose and mouth of an intended user, the sidewall being configured and sized to be hand-held; and the absorbent liner being absorbent to capture and hold the expelled droplets during coughing or sneezing.

9. The combination of claim 8 wherein: the lip portion is generally circular.

10. The combination of claim 8 wherein: the lip portion is moldable to fit snugly against the skin around the nose and the mouth of the intended user.

11. The combination of claim 8 wherein: the: sidewall tapers to a point away from the lip portion.

12. The combination of claim 8 wherein: the cup is cone-shaped.

13. The combination of claim 8 wherein: the absorbent layer extends substantially over the entire inner surface of the sidewall.

14. The combination of claim 8 wherein: the absorbent layer is made from a cotton material.

* * * * *